US009338538B2

(12) United States Patent
Weigold et al.

(10) Patent No.: US 9,338,538 B2
(45) Date of Patent: May 10, 2016

(54) MULTI-MICROPHONE SYSTEM

(71) Applicant: Invensense, Inc., San Jose, CA (US)

(72) Inventors: Jason W. Weigold, Newburyport, MA (US); Kieran P. Harney, Andover, MA (US)

(73) Assignee: INVENSENSE, INC., San Jose, CA (US)

( * ) Notice: Subject to any disclaimer, the term of this patent is extended or adjusted under 35 U.S.C. 154(b) by 404 days.

(21) Appl. No.: 13/871,177

(22) Filed: Apr. 26, 2013

(65) Prior Publication Data

US 2013/0236037 A1 Sep. 12, 2013

Related U.S. Application Data

(63) Continuation of application No. 11/466,669, filed on Aug. 23, 2006, now Pat. No. 8,477,983.

(60) Provisional application No. 60/710,624, filed on Aug. 23, 2005.

(51) Int. Cl.

| | |
|---|---|
| ***H04R 1/08*** | (2006.01) |
| ***H04R 1/40*** | (2006.01) |
| ***H04R 19/00*** | (2006.01) |
| ***H04R 19/04*** | (2006.01) |

(52) U.S. Cl.

CPC ..... *H04R 1/083* (2013.01); *H04R 1/406* (2013.01); *H04R 19/005* (2013.01); *H04R 19/04* (2013.01)

(58) Field of Classification Search

CPC ..... H04R 1/04; H04R 1/40; H04R 1/406; H04R 19/04; H04R 19/005; H04R 19/016; H04R 2201/003; H04R 7/06; H04R 7/20

USPC ..... 381/94.1, 111, 174, 175, 369, 398, 355

See application file for complete search history.

(56) References Cited

U.S. PATENT DOCUMENTS

| | | | | | |
|---|---|---|---|---|---|
| 2,179,361 | A * | 11/1939 | Von Braunmuhl | H04R 19/04 | 181/158 |
| 3,980,838 | A * | 9/1976 | Yakushiji | H04R 19/013 | 381/191 |
| 4,420,790 | A * | 12/1983 | Golke | G01L 9/0073 | 29/25.42 |
| 4,429,190 | A * | 1/1984 | Stockbridge | H04R 1/406 | 29/886 |
| 4,653,606 | A * | 3/1987 | Flanagan | H04R 1/406 | 181/145 |
| 4,751,419 | A * | 6/1988 | Takahata | H04R 1/227 | 310/322 |
| 4,825,335 | A * | 4/1989 | Wilner | G01P 15/125 | 29/25.42 |
| 5,146,435 | A * | 9/1992 | Bernstein | G01H 11/06 | 29/25.42 |
| 5,335,282 | A * | 8/1994 | Cardas | H04R 3/005 | 381/113 |
| 5,388,163 | A * | 2/1995 | Elko | B06B 1/0292 | 381/113 |
| 5,956,292 | A * | 9/1999 | Bernstein | H04R 17/00 | 29/25.35 |
| 6,947,568 | B2 * | 9/2005 | Tanabe | H04R 19/04 | 29/25.41 |
| 2003/0133588 | A1 * | 7/2003 | Pedersen | 381/423 | |
| 2003/0210799 | A1 * | 11/2003 | Gabriel | H04R 1/005 | 381/173 |
| 2008/0212807 | A1 * | 9/2008 | Wang | 381/190 | |

* cited by examiner

*Primary Examiner* — Davetta W Goins
*Assistant Examiner* — Jasmine Pritchard
(74) *Attorney, Agent, or Firm* — Maryam Imam; IPxLaw Group LLP

(57) ABSTRACT

A microphone system implements multiple microphones on a single base. To that end, the microphone system has a base, and a plurality of substantially independently movable diaphragms secured to the base. Each of the plurality of diaphragms forms a variable capacitance with the base and thus, each diaphragm effectively forms a generally independent, separate microphone with the base.

14 Claims, 5 Drawing Sheets

MULTI-MICROPHONE SYSTEM

PRIORITY

This patent application is a continuation application of U.S. patent application Ser. No. 11/466,669, filed Aug. 23, 2006, entitled, "MULTI-MICROPHONE SYSTEM," and naming Jason Weigold and Kieran Harney as inventors, the disclosure of which is incorporated herein, in its entirety, by reference.

This patent application also claims priority from provisional U.S. patent application No. 60/710,624, filed Aug. 23, 2005 entitled, "MULTI-MICROPHONE SYSTEM," and naming Jason Weigold and Kieran Harney as inventors, the disclosure of which is incorporated herein, in its entirety, by reference.

FIELD OF THE INVENTION

The invention generally relates to MEMS microphones and, more particularly, the invention relates to improving the performance of MEMS microphones.

BACKGROUND OF THE INVENTION

Condenser MEMS microphones typically have a diaphragm that forms a capacitor with an underlying backplate. Receipt of an audible signal causes the diaphragm to vibrate to form a variable capacitance signal representing the audible signal. It is this variable capacitance signal that can be amplified, recorded, or otherwise transmitted to another electronic device.

The area of the diaphragm has a direct relation to the total capacitance of the microphone. If too small, it may produce a signal that can be relatively easily corrupted by noise. In addition, a small diaphragm also may produce a signal that is too small to be measured. Conversely, if too large (but having the same thickness as a smaller diaphragm), the diaphragm may bow and thus, produce corrupted signals. Microphones having bowed diaphragms also may have less favorable sensitivity and signal-to-noise ratios.

SUMMARY OF THE INVENTION

In accordance with one embodiment of the invention, a microphone system implements multiple microphones on a single base. To that end, the microphone system has a base, and a plurality of substantially independently movable diaphragms secured to the base. Each of the plurality of diaphragms forms a variable capacitance with the base and thus, each diaphragm effectively forms a generally independent, separate microphone with the base.

The microphone system also may have circuitry (e.g., digital or analog circuitry) for combining the variable capacitance of each microphone to produce a single microphone signal. Moreover, the microphone system may have a plurality of springs for supporting each of the diaphragms above the base. Each one of the plurality of springs may extend between a support structure and one of the diaphragms. In that case, each diaphragm may be spaced from the support structure.

In some embodiments, the base has a top surface facing the plurality of diaphragms, and a bottom surface having a wall that forms a single cavity in fluid communication with each of the plurality of microphones. Alternatively, the bottom surface may have a wall that forms a plurality of cavities. In such alternative case, each microphone may be in fluid communication with at least one of the plurality of cavities.

The diaphragms can be any of a number of shapes, such as circular and rectangular. In addition, the base may have a stiffening rib.

The base can be formed from one of a number of conventional components. For example, the base may be formed from a single die (e.g., a silicon wafer that is processed and diced into separate die). Among other things, the single die may be a single layer die (e.g., formed from silicon), or a silicon-on-insulator die.

In accordance with another embodiment of the invention, a MEMS microphone system has a base forming a backplate, and a plurality of substantially independently movable diaphragms. Each diaphragm forms a variable capacitance with the backplate and thus, each diaphragm forms a microphone with the base.

In a manner similar to other embodiments, the MEMS microphone may be packaged. To that end, the MEMS microphone system also has a package containing the base and diaphragms. The package has an aperture to permit ingress of audio signals.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a microphone system has a plurality of microphones coupled to, and essentially integrated with, the same base. Accordingly, compared to microphones having a single diaphragm of similar area and materials, the sensitivity and signal to noise ratio of such a system should be improved while maintaining a relatively thin profile. Details of illustrative embodiments are discussed below.

Figure 1A:
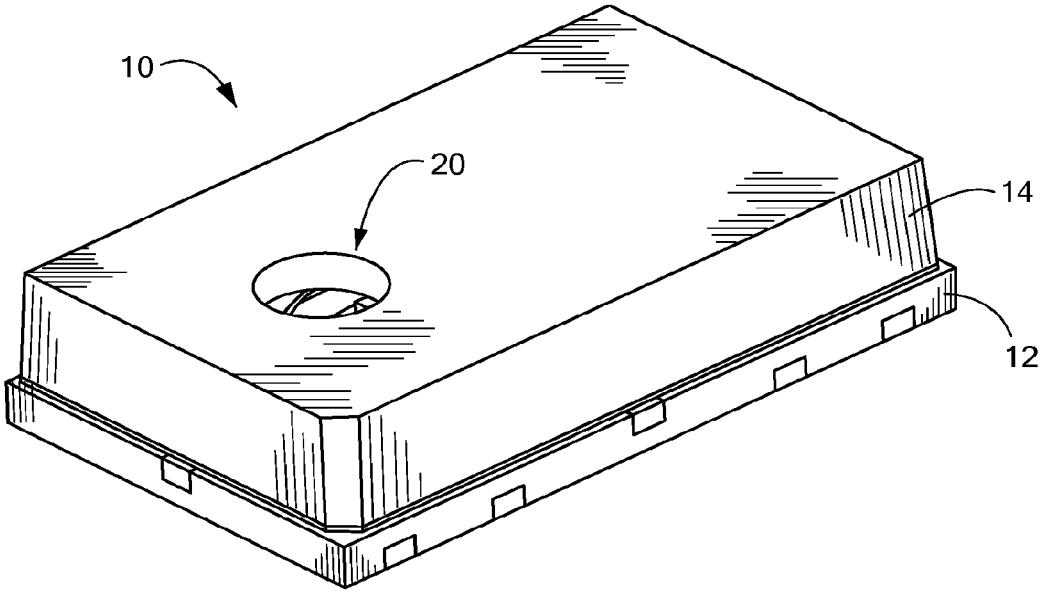
FIG. 1A schematically shows a top, perspective view of a packaged microphone that may be configured in accordance with illustrative embodiments of the invention.

FIG. 1A schematically shows a top, perspective view of a packaged microphone 10 that may be configured in accordance with illustrative embodiments of the invention. In a corresponding manner, FIG. 1B schematically shows a bottom, perspective view of the same packaged microphone 10.

Figure 2:
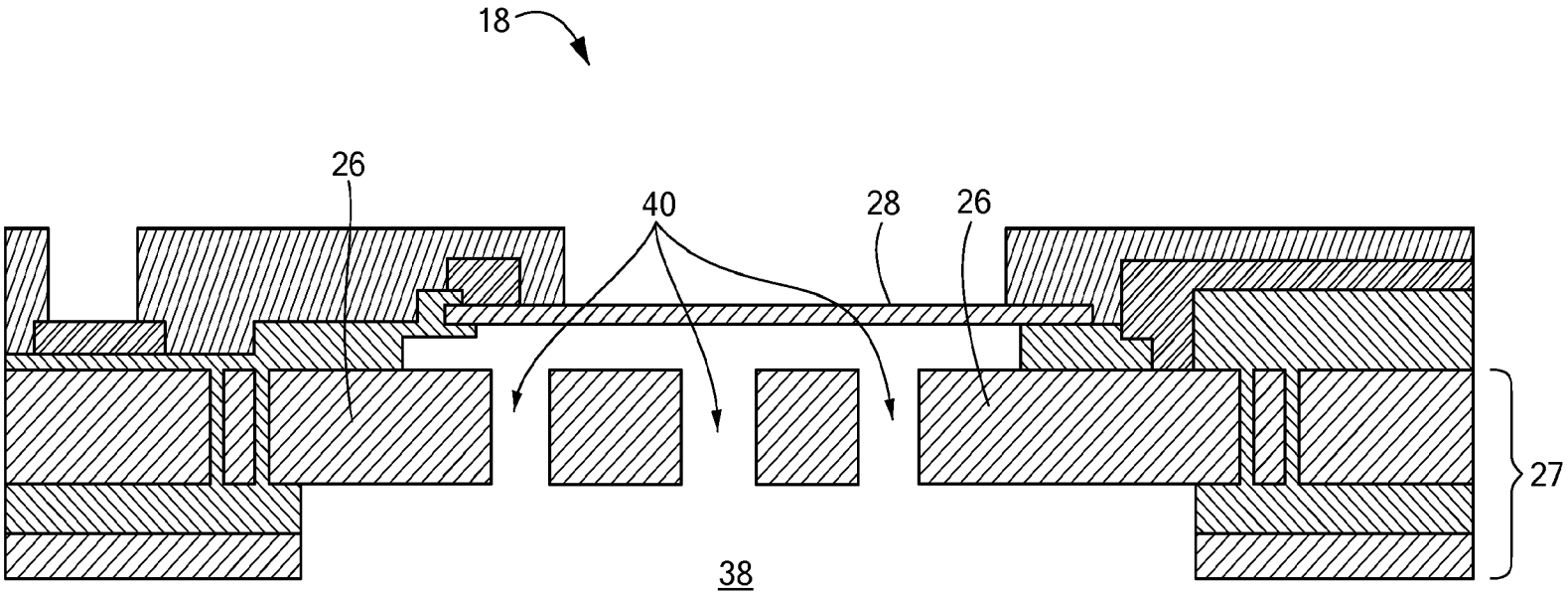
FIG. 2 (Prior Art)
FIG. 2 schematically shows a cross-sectional view of a basic microphone chip.
Figure 3A:
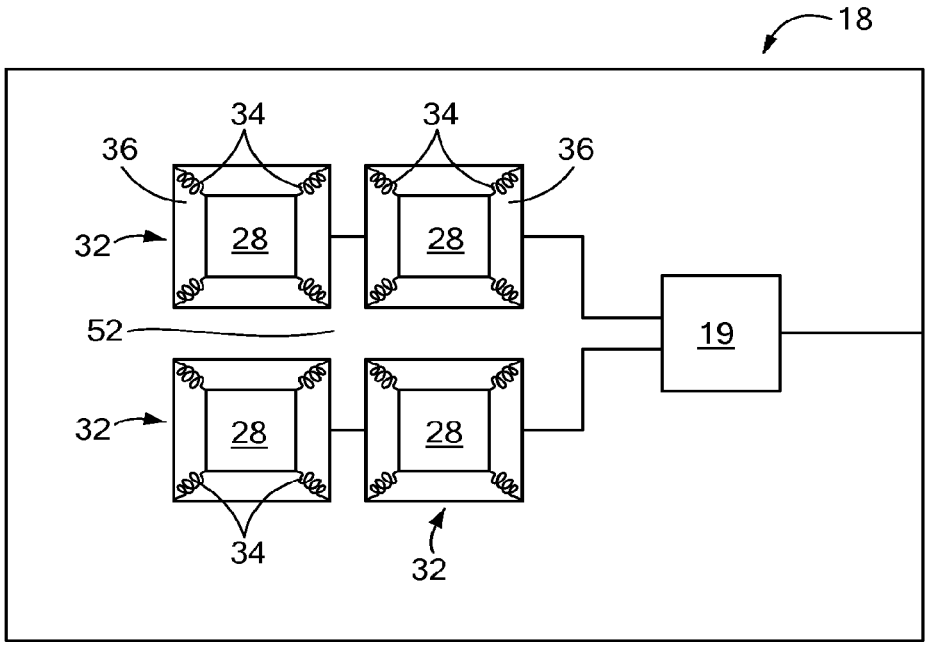
FIG. 3A schematically shows a plan view of a first multi-microphone chip in accordance with one embodiment of the invention.
Figure 3B:
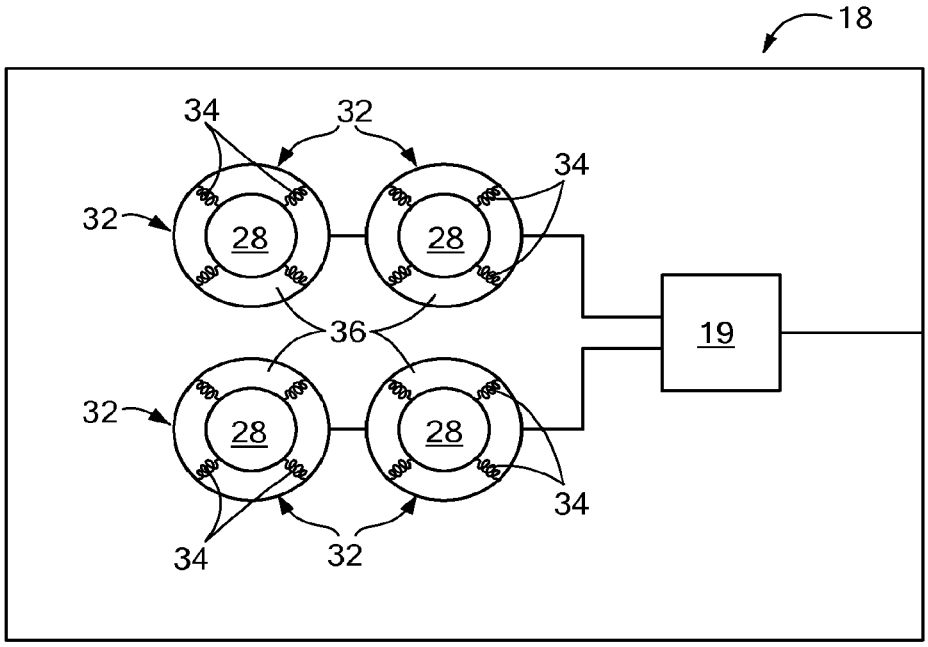
FIG. 3B schematically shows a plan view of a second multi-microphone chip in accordance with another embodiment of the invention.
Figure 5:
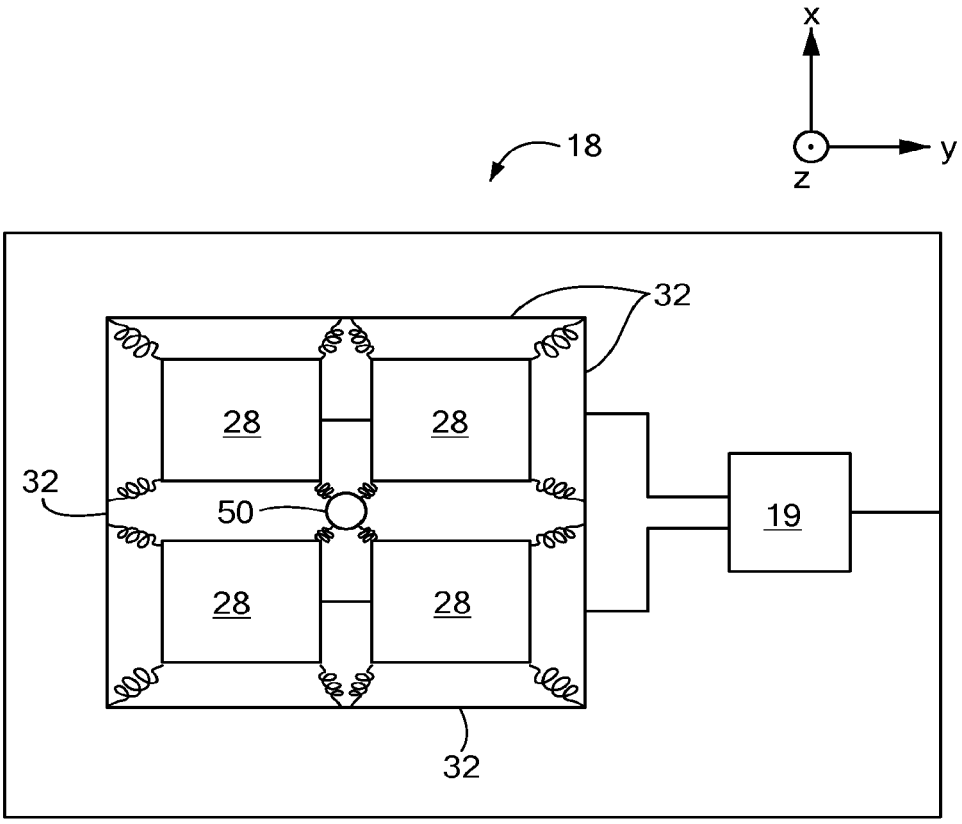
FIG. 5 schematically shows a plan view of a third multi-microphone chip in accordance with yet another embodiment of the invention.

The packaged microphone 10 shown in those figures has a package base 12 that, together with a corresponding lid 14, forms an interior chamber 16 containing a microphone chip 18 (discussed below, see FIG. 2 and others) and, if desired, separate microphone circuitry 19 (shown schematically in FIGS. 3A, 3B, and 5). The lid 14 in this embodiment is a cavity-type lid, which has four walls extending generally orthogonally from a top, interior face to form a cavity. The lid 14 secures to the top face of the substantially flat package base 12 to form the interior chamber.

The lid 14 also has an audio input port 20 that enables ingress of audio signals into the chamber. In alternative embodiments, however, the audio port 20 is at another location, such as through the package base 12, or through one of the side walls of the lid 14. Audio signals entering the interior chamber interact with the microphone chip 18 to produce an electrical signal that, with additional (exterior) components (e.g., a speaker and accompanying circuitry), produce an output audible signal corresponding to the input audible signal.

Figure 1B:
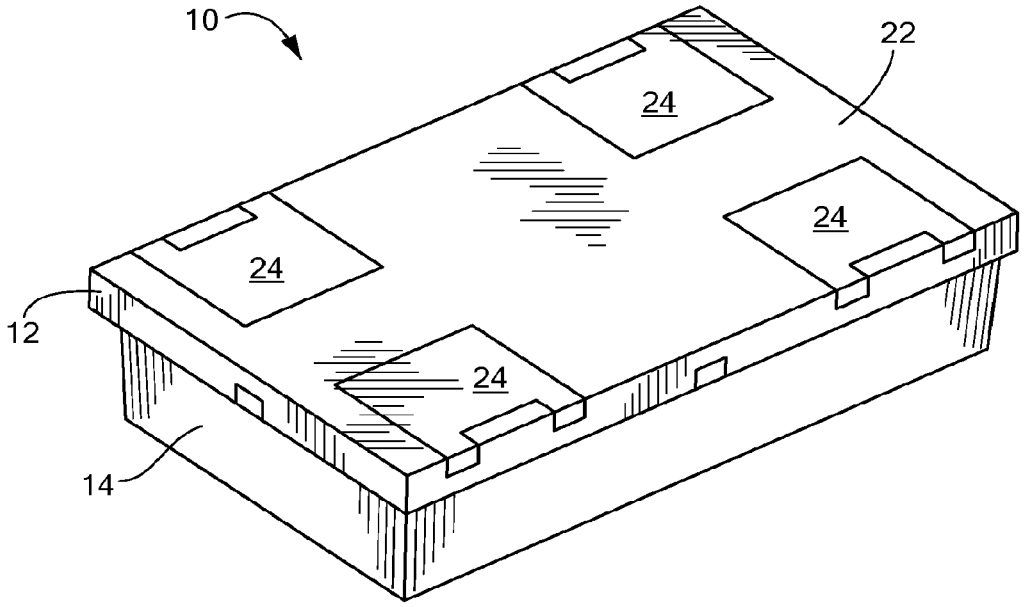
FIG. 1B schematically shows a bottom, perspective view of the packaged microphone shown in FIG. 1A.

FIG. 1B shows the bottom face 22 of the package base 12, which has a number of contacts 24 for electrically (and physically, in many anticipated uses) connecting the microphone with a substrate, such as a printed circuit board or other electrical interconnect apparatus. The packaged microphone 10 may be used in any of a wide variety of applications. For example, the packaged microphone 10 may be used with mobile telephones, land-line telephones, computer devices, video games, biometric security systems, two-way radios, public announcement systems, and other devices that transduce signals. In fact, it is anticipated that the packaged microphone 10 could be used as a speaker to produce audible signals from electronic signals.

In illustrative embodiments, the package base 12 shown in FIGS. 1A and 1B is a premolded, leadframe-type package (also referred to as a "premolded package"). Other embodiments may use different package types, such as ceramic cavity packages. Accordingly, discussion of a specific type of package is for illustrative purposes only.

FIG. 2 schematically shows a cross-sectional view of an unpackaged microelectromechanical system (MEMS) microphone system 18 (also referred to as a "microphone chip 18") having only a single diaphragm. This figure is discussed simply to detail some exemplary components that may make up a microphone produced in accordance with various embodiments.

Among other things, the microphone chip 18 has a chip base 27 with a static backplate 26 that supports and forms a variable capacitor with a flexible diaphragm 28. In illustrative embodiments, the backplate 26 is formed from single crystal silicon (e.g., a part of a silicon-on-insulator wafer or a bulk silicon wafer), while the diaphragm 28 is formed from deposited polysilicon. In other embodiments, however, the backplate 26 and diaphragm 28 may be formed from different materials. For example, the backplate 26 may be formed from deposited polysilicon. To facilitate operation, the backplate 26 has a plurality of through-holes 40 that lead to a back-side cavity 38.

It should be noted that the chip base 27, which includes the backplate 26, can be entirely below the diaphragm 28, or, if the page is turned upside down, entirely above the diaphragm 28. In some embodiments, the chip base 27 is distributed so that the backplate 26 is on one side of the diaphragm 28, while the remainder of the chip base 27 is on the other side of the diaphragm 28. In the embodiment shown in FIG. 2, the chip base 27 includes the backplate 26 and other structure, such as the bottom wafer and buried oxide layer of the SOI wafer.

Audio signals cause the diaphragm 28 to vibrate, thus producing a changing capacitance. Conventional on-chip or off-chip circuitry 19 converts this changing capacitance into electrical signals that can be further processed. This circuitry 19 may be within the package discussed above, or external to the package.

FIGS. 3A and 3B schematically show plan views of two different types of microphone chips 18 configured in accordance with various embodiments of the invention. Both microphone chips 18 have four separate diaphragms 28 that each form a variable capacitor with an underlying chip base 27. In this embodiment, the underlying chip base 27 is a silicon wafer (e.g., part of a silicon-on-insulator wafer, or a single silicon wafer) having the backplate 26, while the diaphragm 28 is formed from deposited polysilicon.

Each diaphragm 28 therefore is considered to form a substantially independent microphone that produces its own variable capacitance output. Conventional on-chip or off-chip circuitry 19 combines the output of all of the microphones to generate a single response to an input audio signal. Among other things, such circuitry 19 may provide a sum total of the variable capacitances of all the microphones on a single chip.

The primary difference between these two microphone chips 18 of FIGS. 3A and 3B, however, is the shape of their respective diaphragms 28. In particular, the microphone chip 18 of FIG. 3A has rectangularly shaped diaphragms 28, while the microphone chip 18 of FIG. 3B has circularly shaped diaphragms 28.

It is anticipated that the rectangularly shaped diaphragms 28 can more readily have a larger combined diaphragm surface area than a same sized microphone chip 18 having circularly shaped diaphragms 28. Consequently, the microphone chip 18 of FIG. 3A should have an improved variable capacitance range, thus providing a more favorable sensitivity and signal to noise ratio. In addition, the rectangularly shaped diaphragms 28 may be spaced more closely together than its circularly shaped counterparts. Among other benefits, close spacing desirably should reduce the effect of parasitic capacitance because, among other reasons, the diaphragms 28 share the same support structure.

Those skilled in the art should appreciate that the diaphragms 28 may take on other shapes. For example, the diaphragms 28 may be octagonal, triangular, or irregularly shaped. In fact, diaphragms 28 may be shaped differently across a single microphone chip 18.

Figure 4:
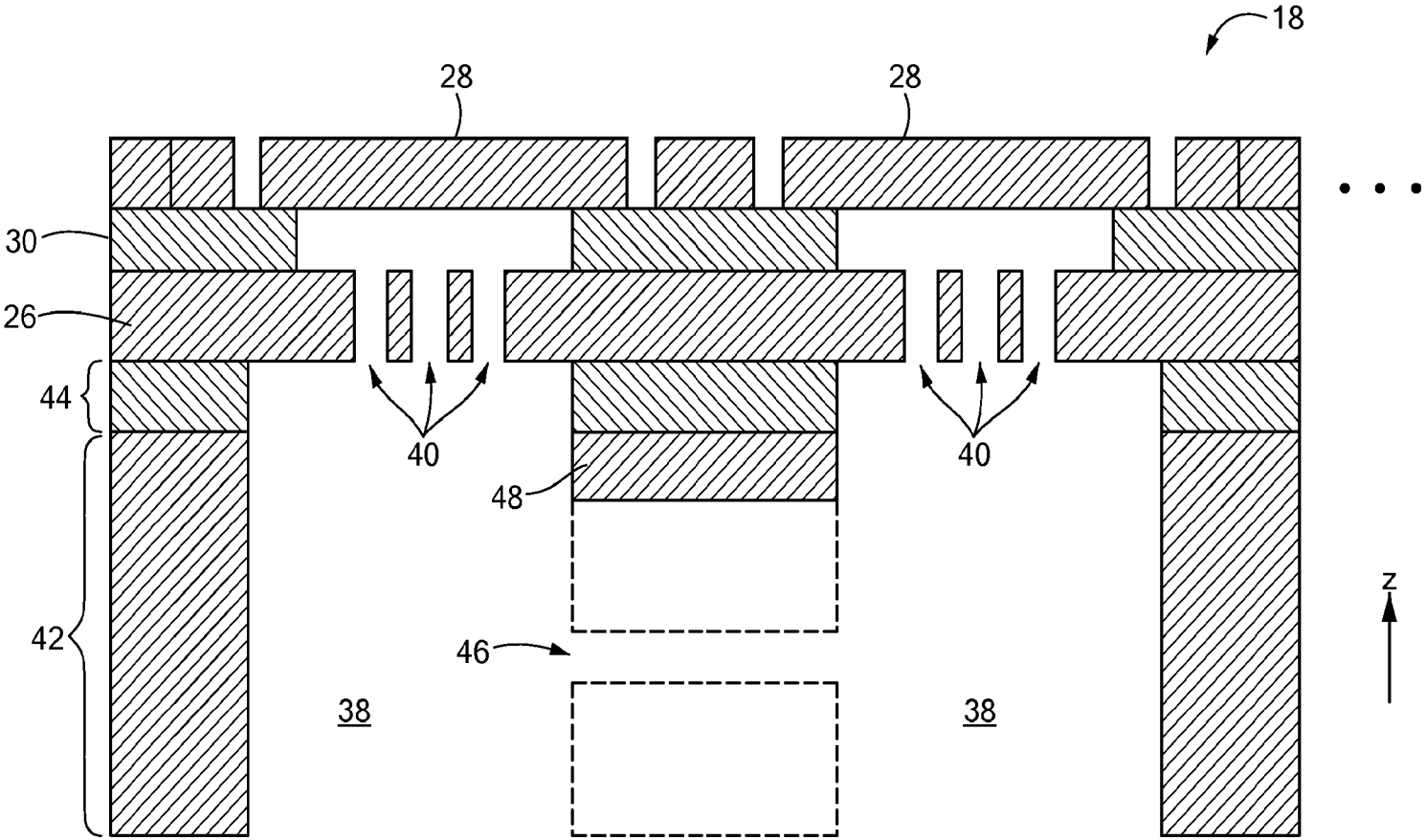
FIG. 4 schematically shows a cross-sectional view of a multi-microphone chip configured in accordance with illustrative embodiments of the invention.

Although their diaphragms 28 are shaped differently, both microphone chips 18 have a number of features in common. Among other things, as noted above, both microphone chips 18 have four separate diaphragms 28 and, as such, effectively form four separate microphones. Each diaphragm 28 thus substantially independently vibrates in response to an audio signal. To that end, each diaphragm 28 is supported above/relative to the chip base 27 by means of an independent suspension system. As also shown in FIG. 4 (schematically showing a cross-sectional view of one of the chips in FIGS. 3A and 3B), as well as in FIGS. 3A and 3B, each microphone chip 18 has a support structure (shown generally at reference numbers 32, 50, and 52, discussed below) that assists in suspending the diaphragms 28.

More specifically, in this embodiment, each microphone chip 18 has a space layer 30 formed on selected portions of a top surface of the backplate 26. Among other things, the space layer 30 may be formed from a deposited or grown oxide. A polysilicon layer deposited on the top surface of the space layer 30 forms the diaphragms 28 and their suspension systems. In particular, as best as shown in FIGS. 3A and 3B, conventional micromachining processes etch this polysilicon layer to form a support structure 32, 50 and diaphragms 28 spaced from the support structure 32, 50. Each diaphragm 28 has four associated, integral springs 34 for movably connecting it with the support structure 32, 50. In illustrative embodiments, the springs 34 are serpentine shaped and evenly spaced around the periphery of each diaphragm 28. It should be noted that different numbers of springs 34 may be used, as well is different types of springs 34.

Accordingly, in illustrative embodiments, each diaphragm 28 has an annular space 36 around it that is interrupted by the springs 34. As known by those skilled in the art, the size of this annular space 36 has an impact on the frequency response of each microphone. Those in the art therefore should carefully select the size of this annular space 36 to ensure that each microphone effectively can process the desired range of frequencies. For example, this annular space 36 can be sized to ensure that the microphones can detect audible signals having frequencies of between 30 Hz and 20 kHz. In illustrative embodiments, the annular spaces 36 of all microphones on a single microphone chip 18 are substantially the same. Alternatively, the size of the annular space 36 of each microphone on a single microphone chip 18 can vary to detect different frequency bands.

Discussion of the specific number of springs 34, as well as the exact placement of those springs 34, is not intended to limit all embodiments of the invention. For example, rather than serpentine springs 34, some embodiments can have springs 34 that extend entirely from the edges of the diaphragms 28 to the circumferentially-located support structure 32, eliminating the annular space 36. Such a spring 34 may give the diaphragm 28 and circumferentially-located support structure 32 the appearance of a drum.

In a manner similar to other MEMS microphones, each microphone chip 18 has a backside cavity 38. As shown in FIG. 4, each microphone chip 18 may have an individual, independent cavity 38 for each microphone. These individual cavities 38, shown cross-sectionally by FIG. 4 in phantom, fluidly communicate with their respective diaphragms 28 by means of corresponding holes 40 through the backplate 26. Each cavity 38 shown in FIG. 4 has a wall formed by the bottom wafer 42 and insulator layer 44 of the SOI wafer used to form the backplate 26. In illustrative embodiments, micromachining processes form these backside cavities after forming the structure on the opposite surface (i.e., the diaphragms 28, springs 34, etc . . . ).

Having multiple backside cavities (rather than a single cavity 38) provides at least one benefit; namely, the extra, retained material of the SOI wafer provides additional support to the backplate 26. By doing so, the backplate 26 should retain its intended stiffness.

It nevertheless may be beneficial for all microphones to share the backside cavities. To that end, some embodiments fluidly communicate the cavities by etching one or more channels 46 through the cavity walls—see the channels 46 in phantom in FIG. 4. Alternatively, or in addition, the profile of the individual backside cavities may be reduced, also as shown in phantom in FIG. 4. This also effectively fluidly communicates all cavities 38. Such embodiments may retain a portion of the bottom wafer 42 of the SOI wafer to act as a stiffening rib 48 for the backplate 26.

Other embodiments completely eliminate all of the separate backside cavities. In such case, the stiffening rib 48 is eliminated so that all microphones on a single microphone chip 18 completely share a single backside cavity 38. Such embodiments should provide a minimal airflow resistance, thus facilitating diaphragm movement.

FIG. 5 schematically shows a plan view of a microphone chip 18 having four microphones, but with a different suspension system. Specifically, rather than having a generally continuous interior support structure 52 (also referred to as "cross-shaped anchor 52") between the diaphragms 28, such as that shown in FIGS. 3A and 3B, this embodiment has a single, narrow anchor 50 (also a support structure) extending along the Z-axis from the chip base 27 at the general center of the chip area having the diaphragms 28. In this embodiment, a significant portion of each diaphragm 28 may be positioned adjacent to, but slightly spaced from, another diaphragm 28—with nothing between the two diaphragms 28. Four springs 34 extend between one corner of each diaphragm 28 and the single anchor 50 to partially suspend the diaphragms 28. In a corresponding manner, each diaphragm 28 also has three additional associated springs 34 that movably secure it to the circumferentially-located support structure 32.

Viewed another way, this embodiment has a circumferentially-located support structure 32 that surrounds the outside of all four diaphragms 28 and, if the diaphragms 28 and springs 34 were not present, would form an open region having only the single anchor 50. This is in contrast, for example, to the microphone chip 18 of FIG. 3A, which has a cross-shaped anchor 52 between all the diaphragms 28. The single anchor 50 of this embodiment therefore replaces the cross-shaped anchor 52 of the embodiment shown in FIG. 3A. Consequently, the four diaphragms 28 of this embodiment may be spaced more closely together, thus providing further performance enhancements.

Compared to MEMS microphones having single diaphragms 28 of like materials with a corresponding area, these smaller diaphragms 28 are less likely to bow or otherwise droop at their centers. As noted above, bowing or drooping can have an adverse impact on microphone sensitivity and signal to noise ratio. Bowing or drooping also can contribute to stiction problems. Also, compared to their larger counterparts, smaller diaphragms 28 are more likely to uniformly deflect (e.g., mitigate plate bending issues).

For the same reasons, plural smaller diaphragms 28 may be formed to have a lower profile than their larger counterparts because of their reduced lengthwise and widthwise dimensions (i.e., they are less likely to bow). Despite their lower profiles, which is preferred in various micromachined technologies, such diaphragms 28 are expected to have sensitivities that are comparable to, or better than, microphones having a single diaphragm 28 with substantially the same surface area (as suggested above).

Moreover, it is anticipated that multiple microphones on a single die sharing support structure 32 will have a synergistic effect on microphone sensitivity. For example, four such microphones should have better sensitivity than four like microphones on different chips. This is so because each of the separate microphones have local support structure that degrades performance. Accordingly, four separate microphones have four times such degradation. This is in contrast to illustrative embodiments, in which parasitic capacitances and other degrading factors of a single microphone chip are at least partially shared among the four microphones, thus reducing the impact of the degradation and improving overall sensitivity.

Although the above discussion discloses various exemplary embodiments of the invention, it should be apparent that those skilled in the art can make various modifications that will achieve some of the advantages of the invention without departing from the true scope of the invention.

What is claimed is:

1. An apparatus comprising:

a microphone die having a conductive backplate with a plurality of holes, the microphone die also having an electrical interconnect coupled with the backplate to transmit electric signals, the microphone die supporting a plurality of diaphragms, the backplate being spaced from the plurality of diaphragms to form a corresponding number of variable capacitances with the plurality of diaphragms, each of the diaphragms being substantially independently movably secured to the die, wherein the backplate spans the plurality of diaphragms, each diaphragm being movable relative to the backplate, the backplate forming a separate microphone with each diaphragm; a plurality of springs configured to support each of the diaphragms relative to the die, wherein each one of the plurality of springs extends between a support structure of the die and one of the diaphragms, each diaphragm being spaced from the support structure.

2. The apparatus as defined by claim 1 further comprising circuitry operable to combine the variable capacitance of each microphone to produce a single microphone signal.

3. The apparatus as defined by claim 1 wherein the backplate has a top surface and a bottom surface, the top surface facing the plurality of diaphragms, the bottom surface having a wall that forms a single cavity that is in fluid communication with each of the plurality of microphones.

4. The apparatus as defined by claim 1 wherein the backplate has a top surface and a bottom surface, the top surface facing the plurality of diaphragms, the bottom surface having a wall that forms a plurality of cavities, each microphone being in fluid communication with at least one of the plurality of cavities.

5. The apparatus as defined by claim 1 wherein each of the diaphragms is rectangular.

6. The apparatus as defined by claim 1 wherein the die has a stiffening rib.

7. The apparatus as defined by claim 1 wherein the die comprises an SOI wafer.

8. A MEMS die comprising:

a conductive MEMS backplate having a plurality of holes;

a plurality of substantially independently movable diaphragms wherein the backplate spans the plurality of diaphragms, the backplate forming a plurality of individual variable capacitances with the plurality of diaphragms, the backplate forming a microphone with the plurality of diaphragms; a plurality of springs operable to support each of the diaphragms relative to the backplate, wherein each one of the plurality of springs extends between a support structure and one of the diaphragms, each diaphragm being spaced from the support structure.

9. The MEMS die as defined by claim 8 wherein the backplate forms a single cavity for each of the microphones.

10. The MEMS die as defined by claim 8 wherein at least one of the microphones includes at least one hole through the backplate.

11. The MEMS die as defined by claim 8 further comprising a package containing the backplate and diaphragms, the package having an aperture to permit ingress of audio signals.

12. A MEMS microphone system comprising:

a generally rigid support structure having a single backplate with a plurality of holes; and a plurality of substantially independently movable, flexible diaphragms, the backplate forming a plurality of individual variable capacitances with the plurality of diaphragms, the backplate forming a microphone with the plurality of diaphragms, wherein the backplate spans the plurality of diaphragms.

13. The MEMS microphone system as defined by claim 12 wherein the support structure comprises a single die, and further including springs for movably coupling the diaphragms with the support structure.

14. The MEMS microphone system as defined by claim 12 wherein the backplate permitting air flow through the support means.

* * * * *